United States Patent [19]

Friedrich

[11] Patent Number: 4,913,197

[45] Date of Patent: Apr. 3, 1990

[54] DEVICE AND PROCESS FOR PREPARING AND DISPENSING SPONTANEOUSLY FOAMING MATERIALS FOR FILLING A CONTAINER

[75] Inventor: Richard Friedrich, Engen, Fed. Rep. of Germany

[73] Assignee: Hafesto AG, Zurich, Switzerland

[21] Appl. No.: 160,250

[22] Filed: Feb. 25, 1988

[30] Foreign Application Priority Data

Feb. 25, 1987 [CH] Switzerland ..... 719/87

[51] Int. Cl.[4] ..... B65B 3/04; B65B 31/00

[52] U.S. Cl. ..... 141/3; 141/11; 141/9; 141/20; 141/69; 141/100; 141/104; 141/105; 366/332

[58] Field of Search ..... 336/332–334; 141/1, 98, 3, 18, 9, 20, 11, 69, 70, 100, 104, 105, 106, 107

[56] References Cited

U.S. PATENT DOCUMENTS

| | | | |
|---|---|---|---|
| 2,615,692 | 10/1952 | Muller | 366/332 X |
| 2,995,521 | 8/1961 | Estignard-Bluard | 252/90 |
| 3,232,324 | 2/1966 | Sokol | 141/3 |
| 3,330,773 | 7/1967 | Hart | 252/305 |
| 3,484,378 | 12/1969 | Reich et al. | 252/90 |
| 3,534,771 | 10/1970 | Eyerdam et al. . | |
| 3,541,581 | 11/1970 | Monson | 252/90 |
| 3,599,940 | 8/1971 | Peoples | 366/124 |
| 3,651,997 | 3/1972 | Venus, Jr. . | |
| 3,705,855 | 12/1972 | Marschner | 252/90 |
| 3,728,265 | 4/1973 | Cella et al. | 252/90 |
| 3,728,276 | 4/1973 | Lieberman et al. | 252/305 |
| 3,745,741 | 7/1973 | Cunningham | 53/88 |
| 3,797,534 | 3/1974 | Skidmore | 144/145 R |
| 3,847,571 | 11/1974 | Cole | 55/87 |
| 3,995,666 | 12/1976 | Micheals | 141/3 |
| 4,101,055 | 7/1978 | Poitras | 141/104 X |
| 4,191,224 | 3/1980 | Bontrager | 141/100 |
| 4,272,199 | 6/1981 | Hade | 366/333 X |
| 4,405,489 | 9/1983 | Sisbarro | 252/305.4 |
| 4,463,784 | 8/1984 | Butcher et al. | 141/20 |
| 4,727,914 | 3/1988 | Anderson, III et al. | 141/105 |

FOREIGN PATENT DOCUMENTS

| | | |
|---|---|---|
| 0105537 | 8/1983 | European Pat. Off. . |
| 0178573 | 4/1986 | European Pat. Off. . |
| 970926 | 11/1958 | Fed. Rep. of Germany . |
| 1006752 | 10/1965 | United Kingdom . |
| 1164251 | 9/1969 | United Kingdom . |
| 1287126 | 8/1972 | United Kingdom . |
| 1303890 | 1/1973 | United Kingdom . |
| 2153010 | 8/1985 | United Kingdom . |

*Primary Examiner*—Ernest G. Cusick

*Attorney, Agent, or Firm*—Antonelli, Terry & Wands

[57] ABSTRACT

In order to fill a container having a check valve with a spontaneously foaming filling material, the latter is introduced through the check valve already mounted at the container. In a piston arrangement as the filling device, filling material to be filled in is sucked into a mixing chamber (65) by means of a metering piston (60), foam gas is injected through the piston rod (58) of this piston, filling material and gas are mixed by means of a mixing piston (56), then forced by means of the metering piston (60) through the check valve into the container. This prevents frothing of the filling material, intermixed with foam gas, at any point in time between mixing and filling. During mixing, slight foaming is desirable in order to increase the absorption capacity for the foam gas.

13 Claims, 7 Drawing Sheets

DEVICE AND PROCESS FOR PREPARING AND DISPENSING SPONTANEOUSLY FOAMING MATERIALS FOR FILLING A CONTAINER

BACKGROUND AND SUMMARY OF INVENTION

The present invention relates to a process of filling a container with a filling material wherein the container comprises an outlet valve designed as a check valve, opened by an external action; a device for the preparation and filling of a spontaneously foaming filling material into a container, with a filling material chamber, the volume of which adjusts itself in accordance with a pressure difference between its interior and its surroundings; as well as to a method for its operation.

It is known to fill containers of the above type with the filling material before the check valve is attached, sealing the container. The fact that an intermediate phase is provided between filling the container and sealing application of the valve, during which the filled-in material is exposed to the outside through the container opening, on which then the valve is mounted, and thus can be contaminated, constitutes an essential drawback of these processes: Prevention of possible contamination, such as of filling materials that must be kept sterile, can be ensured only at great expense.

It is an object of the present invention, inter alia, to eliminate this disadvantage in a process of the aforementioned type.

This object has been attained by filling in the filling material through the outlet valve.

If the filling material to be filled in is subjected outside of the valve to a higher pressure than the closing pressure of the check valve, then the latter opens, and the filling material can flow through the valve into the container.

If, in this connection, the pressure in the filling material required for filling is to be reduced, then it is suggested in another embodiment of the process to locate, during filling, the external, opening action, such as by conventionally exerting pressure on a valve cap, at the outlet valve, in other words, to operate the outlet valve as during the subsequent discharging of the filling material, thereby opening this valve.

The above-described conventional filling procedure exhibits special disadvantages, in addition to the aforementioned danger of contamination, for the filling of spontaneously frothing filling materials. These filling materials start frothing as soon as they exit at room temperature into the normal ambient pressure. For this reason, measures must be taken when employing the above-mentioned known procedures for preventing foaming of the filling material in the container at least between filling and the mounting of the outlet valve, actually until the filled-in material has been placed under pressure.

Customarily, the procedure here is such that the liquid filling material component is mixed with the foam gas in a high-pressure tank. During this step, the high-pressure tank with the filling material and the foam gas is cooled down to a temperature at which the spontaneous-foaming activity of the mixing material is greatly reduced even at ambient pressure. In this cooled-down condition, the mixing material is then filled into the container; the low temperature of the material delays frothing within the container during the time between filling and mounting of the outlet valve. Since the time span of the delay is relatively limited, high requirements must be met by this process regarding precision and speed in applying the outlet valve after the filling step. However, ambient pressure is precisely the variable preventing frothing; this pressure can be raised only once the mixing material is in a sealed space, i.e. once the valve has been mounted.

Containers for accommodating such spontaneously frothing filling materials usually comprise an inner container altering its volume as a function of a pressure difference between internal and external pressure, and are designed as twin-chamber containers. The external pressure prevents frothing and acts as a propelling pressure for the discharge of the material. The container comprises, for example, a piston sealingly movable along the inside wall of a can, this piston driven by a spring and/or propellant gas causing the material to move toward the outlet valve, or an inner bag, a propellant gas under pressure being provided between the inner bag and an inner wall of a can which, after filling of the inner bag, drives the material to the outside upon operating the outlet valve. Also the inherent elasticity of such a bag can ensure internal pressure.

By means of a further development of the process according to this invention wherein by application of a corresponding pressure difference the filling material chamber is allowed to collapse to its minimum volume, and a liquid component of filling material is mixed under pressure with a foam gas and is forced under pressure through the outlet valve into the filling material chamber while undergoing volume expansion, the objective is attained that the pressure of the propellant gas, generally pressure of the propellant medium, which prevents frothing, can be provided in the corresponding chamber of the container prior to filling the material chamber, this pressure then increasing further during the filling step. The propellant gas pressure set at the beginning of the filling operation is, however, already sufficient for precluding any frothing.

This ensures that the spontaneously frothing filling material is always maintained under a pressure that prevents frothing, from the instant at which the material is imbued with its self-frothing property, i.e. starting with mixing of the liquid filling material component with the foam gas until and during the filling step; during the filling process, the inner container forms a closed system with a container wherein the mixing step is performed under pressure.

According to the invention, a device for the preparation and filling of a spontaneously foaming filling material into a container with a filling material chamber, the volume of which adjusts itself in accordance with a pressure difference between its interior and its surroundings, comprises a pressure container with a pressure source for producing the internal pressure, a mixer active in the pressure container, and inlets for a liquid filling material and a foam gas into the container, as well as a proportioning means to discharge the filling material, blended with foam gas, under pressure from an outlet.

Although it is definitely possible, under the propulsion action of the pressure in the pressure container, to effect proportioning by corresponding operative control, for example of a block valve, and to generate the pressure in the pressure vessel by using a compressor as the pressure source, it is preferred to utilize at least one piston in the pressure vessel designed as a pressure cylinder as the pressure-generating source and the proportioning device.

Advantageously, the mixer is furthermore designed as a mixing piston.

Due to the fact that a piston rod of the mixing piston slides coaxially in a piston rod tube of the pressure and metering piston, a maximally compact construction of the device is achieved.

It is furthermore suggested to design the piston rod of the mixing piston as a feed pipe for one and/or the other component of the mixing material, this pipe terminating, preferably via a check valve, into the pressure cylinder chamber at the piston face of the mixing piston.

The invention will be described below by examples, referring to figures.

DETAILED DESCRIPTION OF DISCLOSED EMBODIMENTS

Figure 1:
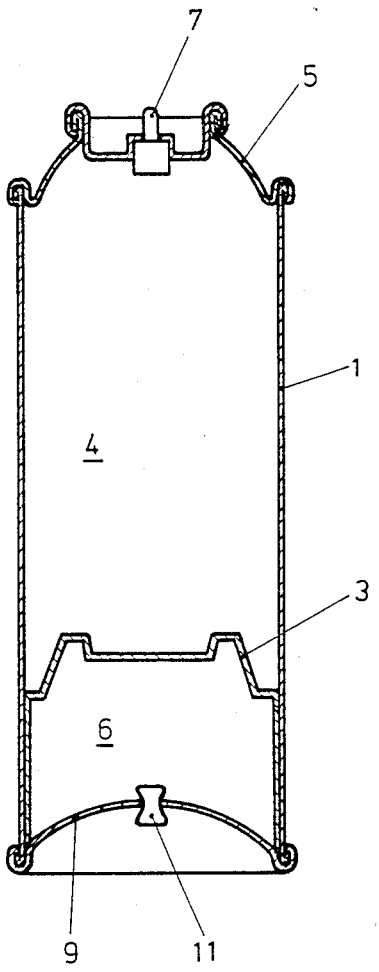
FIGS. 1 and 2 show, for purposes of an overview, schematic illustrations of two practical versions of conventional twin-chamber containers.
Figure 2:
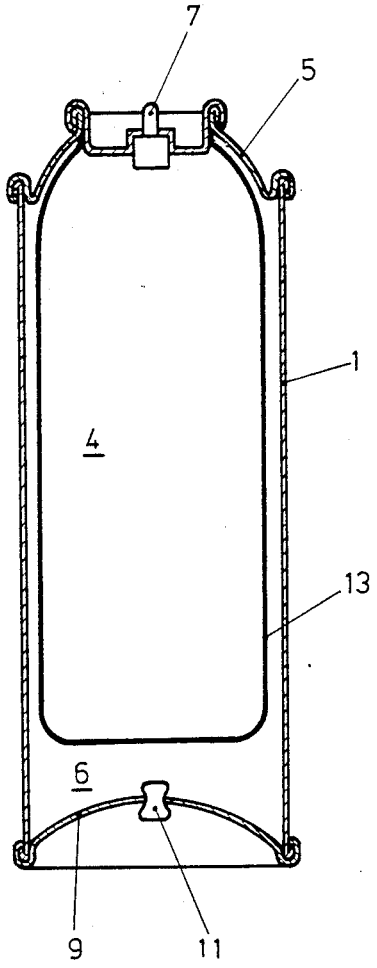

FIGS. 1 and 2 show schematic longitudinal sectional views of conventional twin-chamber containers. According to FIG. 1, such a container comprises a can 1 wherein a piston 3 can be sealingly displaced. An outlet valve 7 is sealingly mounted on a cover dome 5 of the can 1. Above the piston 3, the can 1 with the dome 5, sealed by the outlet valve 7, constitutes a material chamber 4 for a filling material. Below the piston 3, a propellant chamber 6 is defined by the latter and a bottom portion 9 in the can 1, a propellant gas being filled in, for example, through an opening that can be sealed by a pin 11. During operation, the propellant gas places the filling material, via the piston 3, under pressure so that the material is discharged upon opening of the outlet valve 7 designed as a check valve. Opening of the outlet valve 7 is effected conventionally by mechanical stress, such as by axial or eccentric pressure on its valve head.

In the embodiment according to FIG. 2, a flexible inner container 13 is provided in the valve region of the dome 5. This inner container here, too, subdivides the container into a material chamber 4 to accommodate the filling material, and between inner container and can wall, a propellant chamber 6, such as for accommodating a propellant gas. Here again, a propellant gas is introduced into the chamber 6 through a bottom opening sealable by the pin 11. The filling material is introduced into the chamber 4. During operation, upon opening of the outlet valve 7, the filling material is forced out by the pressure of the propellant gas on the flexible wall of the inner container 13.

Containers operating without subdivision of the container into a chamber for the propellant gas and a chamber for the filling material, wherein the propellant gas is forced directly into the chamber with the filling material, are denoted as single-chamber containers.

Furthermore, containers are also known wherein a rubber-elastic inner container is provided. The discharge pressure for a filling material is realized by the feature that, during introduction of the filling into the inner container, the wall of the latter is expanded so that the aforementioned elasticity ensures propulsion pressure in the inner container. Such containers are likewise called single-chamber containers.

In all cases, as mentioned, an outlet valve is provided preventing efflux of the pressurized filling from the container and being opened by mechanical external stress, customarily by exerting pressure on the valve head.

The process according to this invention and described hereinbelow is suitable for filling containers of all cited structures.

Figure 3:
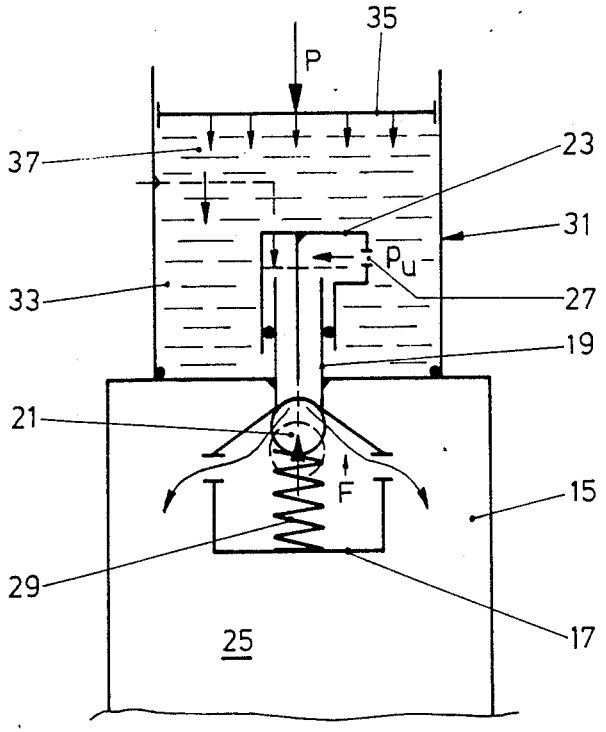
FIG. 3 shows a schematic view of a container with an outlet valve functioning as a check valve in order to explain the process of this invention.

FIG. 3 illustrates schematically a valve portion of such a container in order to explain the process of this invention. The representation of the outlet valve 15 does not claim to reflect the structure of check valves known in this connection but rather merely shows schematically the parts basically necessary in such a valve for its functioning. These parts comprise a valve housing 17 with a valve disk 21 driven against the discharge end of an outlet nipple 19 and here illustrated as a ball. A mechanical operating element 23 is movably arranged on the nipple 19 and engages the valve disk 21 in order to lift same off its seat against a closing force F and to vacate a passage from the inner space 25 of the container to an outlet nozzle 27.

The inner space 25 can be a filling chamber of a twin-chamber container according to FIGS. 1 and 2, or, alternatively, the inner container chamber of a single-chamber container.

The valve disk 21 is maintained in the closed position either solely by the pressure difference of the filling material that is under pressure in the inner chamber 25 of the container, or, as illustrated, supported by a valve spring 29.

Figure 4A:
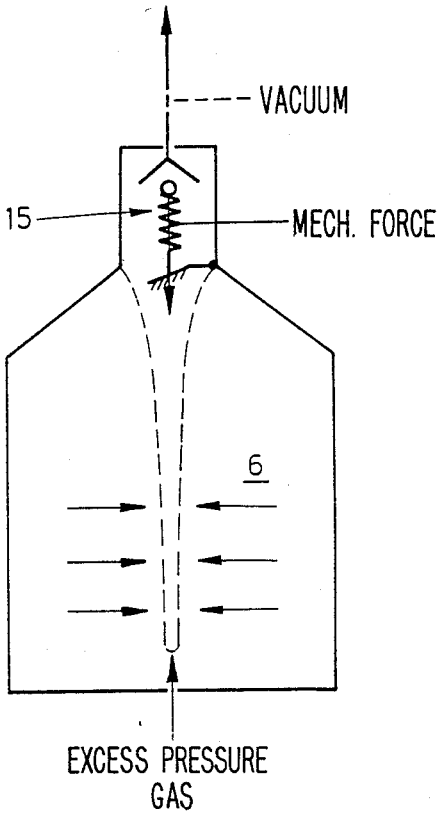
FIGS. 4*a*–4*c* show the process steps of the embodiment of the process of this invention in connection with a twin-chamber container.
Figure 4B:
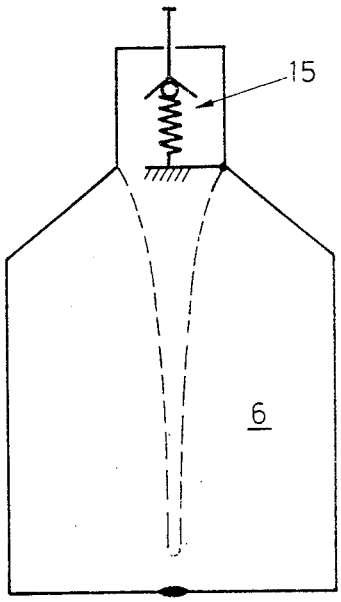
Figure 4C:
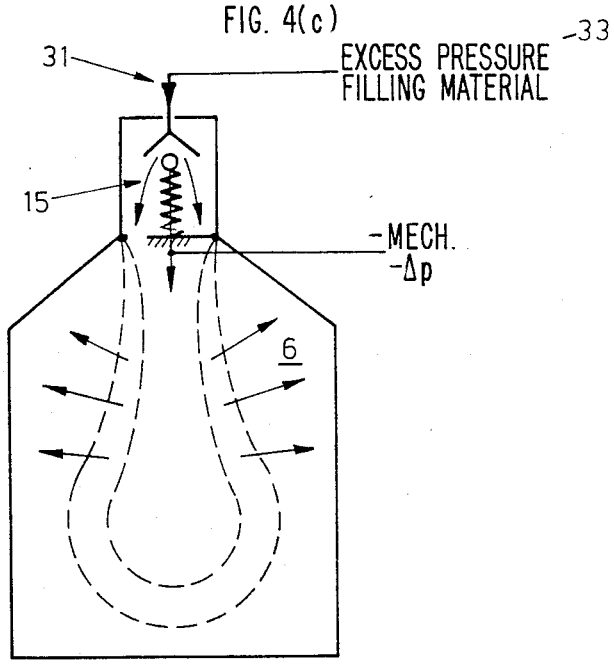
Figure 5:
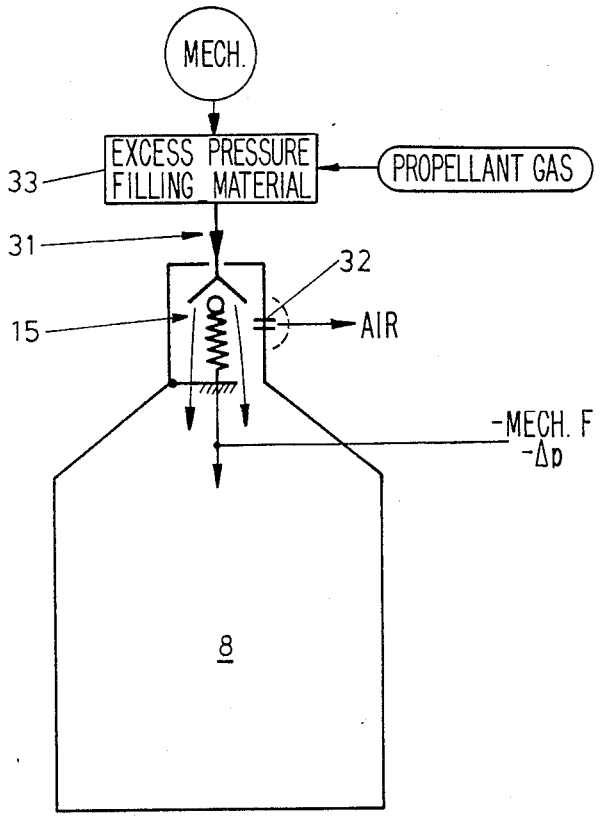
FIG. 5 shows, in an illustration analogous to FIG. 4, the process of this invention in conjunction with a single-chamber container wherein propellant gas and filling material to be utilized are not separated.

According to the invention, the procedure for filling the container is as follows:

The starting point is a container where the outlet valve 15 has already been mounted. In the containers according to FIGS. 1 and 2, the propellant gas chamber 6 is first filled, as illustrated in FIG. 4, with propellant gas under pressure through the opening in the bottom portion 9 so that the filling material chamber 4 occupies its smallest possible volume. During this step, the outlet valve 15 is opened so that the air present in the filling chamber 4 can escape. Collapsing or assumption of the minimum volume of the filling chamber 4 is supported, if need be, by applying a vacuum to the opened outlet valve 15. In case of a single-chamber container, the container is evacuated, if necessary, through the opened outlet valve 15, then the valve is closed again. In all instances, as illustrated in FIG. 3, furthermore in FIG. 4(*c*) or FIG. 5 schematically, the container is sealingly placed in communication with a filling system 31. The latter includes a pressure tank 33 with the filling material 37 to be dispensed under pressure. As illustrated in FIG. 3, the filling material is placed under pressure in the pressure tank 33 by means of a pressure piston 35. If the pressure acting from the outside on the valve disk 21 and denoted by $p_u$ becomes so high that the resultant opening force acting on the valve disk 21 becomes greater than the closing force F, then the valve 15 open up. Thereby, the valve disk 21 is lifted off its seat on the nipple 19. The filling is forced from the pressure container 33 through the valve 15 into the inner chamber 25, as the case may be into a material chamber 6 or into the inner space 8 of a single-chamber container as shown in FIG. 5 or with a rubber-elastic wall. Insofar as the receiving chamber 8 for the material has not been evacuated prior to the filling step in case of a single-chamber container according to FIG. 5, a vent port 32 must be opened during the filling step, but this port can be relatively small and is thereafter quickly sealed closed.

By means of the filling procedure as described thus far, the objective is attained that the container can be finished in its manufacture as a single- or twin-chamber container, including the mounting of the outlet valve 15, and that the filling material can be introduced without coming into contact with the open surroundings in the meanwhile. If the container is a single-chamber tank with propellant gas, then the latter is injected into the receiving chamber 8 of the container, simultaneously with the filling material or after the latter has been filled in, through the outlet valve. In this connection, the propellant gas can already be forced into the pressure tank 33 whereby it enhances the forced introduction of the filling material through the outlet valve 15 into the chamber 8, from which the gas thereafter, during use of the container and dispensing of the filling material, expels the filling material again with externally opened outlet valve. The propellant gas then acts analogously to the piston 35 in FIG. 3.

Thus, according to FIG. 4, the individual steps for the filling of twin-chamber containers are as follows:

(a) Introducing propellant gas under pressure into the propellant gas chamber 6; opening outlet valve 15; if need be, enhancing emptying of the filling material chamber by application of vacuum to the outlet valve 15.

(b) Sealing the opening for introducing the propellant gas into the propellant gas chamber 6; the outlet valve 15 is closed during this step.

(c) Filling in the filling material under excess pressure through the outlet valve 15; opening of valve 15 by means of a pressure difference between the filling material to be filled in and the filling material chamber 4 and/or by opening the valve mechanically; pressure in propellant gas chamber 6 rises with the amount of forced-in filling material.

When used in connection with a single-chamber container having a rubber-elastic inner chamber wall, the procedure according to (c) is adopted.

As will be discussed below, the feature that, according to the process of this invention, the filling material must be forced under pressure into the interior of the container through the outlet valve designed as a check valve makes it possible in a highly simple way to utilize the arrangement for the relatively problematic filling of a frothing filling material.

Figure 6:
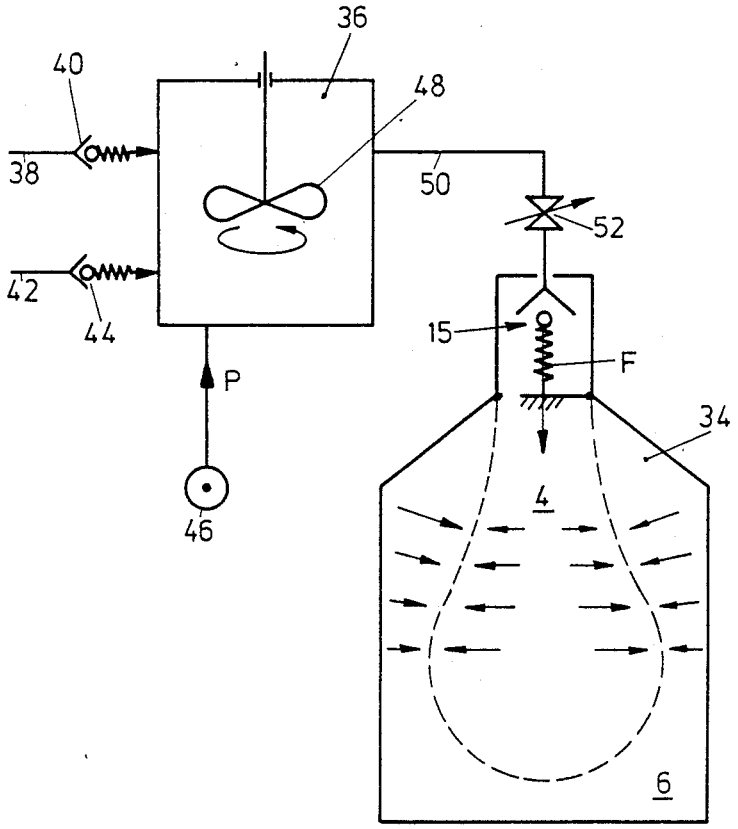
FIG. 6 is a schematic view of a device according to this invention.

According to FIG. 6, the liquid filling is introduced into a pressure container 36 by way of a first conduit 38, preferably with check valve 40. Foam gas is forced into the pressure container 36 by way of a second conduit 42, preferably likewise with check valve 44. In the pressure vessel 36, filling and foam gas are placed under pressure P by means of a pressure source 46. An agitator 48 mixes the liquid filling with the foam gas in the pressure vessel 36. The outlet valve 15 of a twin-chamber container 34 with a propellant gas chamber 6 filled with a propellant gas and with a filling chamber 4 initially collapsed or reduced to minimum volume is sealingly joined to a filling material outlet conduit 50 with a block valve 52. The valve 15 is opened by exerting mechanical pressure on the valve housing. In this connection, the pressure P of the pressure source 46 is chosen to be higher than the pressure of the propellant gas in the propellant gas chamber 6, with which the filling material with the foam gas is forced under pressure into the filling material chamber 4 and the latter is expanded, with constant increase in the propellant gas pressure in the propellant gas chamber 6. Consequently, during the filling step, the pressure tank 36, the conduit 50, the filling material chamber 4 are in communication as an externally closed pressure system. Accordingly, the filling, mixed with the foam gas, is always under pressure and therefore the mixed material cannot form a slurry.

However, a preferred version is the following:

Again, liquid filling material is filled into the pressure container 36 via the conduit 38, preferably with check valve 40, in such a way that the pressure tank 36 is not entirely full. The agitator 48 is set into operation, and simultaneously foam gas is injected via the second conduit 42, preferably likewise having a check valve 44. On account of the residual volume remaining due to the incomplete filling of the tank 36 with liquid filling material, slight frothing of the filling occurs immediately during mixing. Thereby, the surface area of the product is enlarged and this enlarged surface area increases the absorption capacity for the foam gas fed subsequently. Absorption of the foam gas and mixing of this gas with the filling take place in this way within an extremely brief time period. After termination of the feeding and mixing process, the filling with the foam gas is filled into the twin- or single-chamber container as described in the foregoing by the application of an additional pressure at the pressure tank 36, through outlet valve 15.

Figure 7:
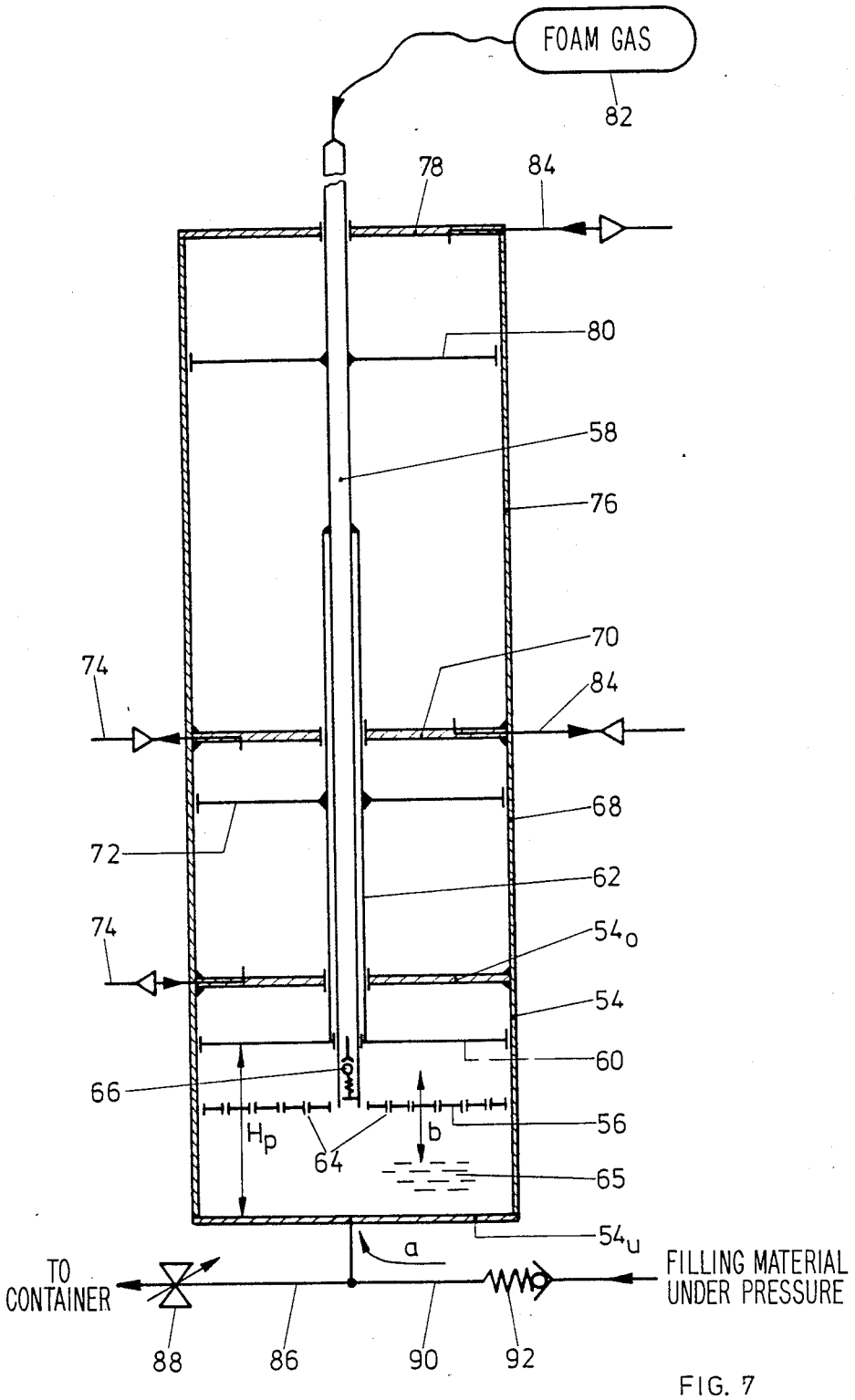
FIG. 7 is a preferred embodiment of the device according to this invention in a schematic longitudinal sectional view.

FIG. 7 shows a preferred embodiment of a device for preparing and filling a spontaneously frothing liquid material in accordance with the principle illustrated in FIG. 6.

A mixing and metering cylinder 54 is limited in its height at the top and at the bottom by cylinder walls $54_o$ and $54_u$, respectively. In the mixing and proportioning cylinder 54, a mixing piston 56 moves slidingly, with a piston rod 58 designed as a pipe. A pressure and proportioning piston 60 slides, between the mixing piston 56 and the top wall $54_o$ of the mixing and proportioning cylinder 54, sealingly with a central opening along the mixing piston rod 58 and sealingly with its periphery along the cylinder wall of the cylinder 54. The piston 60 exhibits a tubular piston rod 62 wherein the mixing piston rod 58 slides coaxially and, as mentioned, sealingly. A metering volume of the filling material 65 to be filled is predetermined by the piston displacement fixedly provided in the cylinder 54 between the proportioning piston 60 and the lower cylinder wall $54_u$, in correspondence with the set stroke $H_p$. The mixing piston 56 reciprocates in a pendulating fashion, in a way that will be described below, between the upper limitation given by the metering piston 60 and the lower limitation given by the cylinder wall $54_u$ and effects, thanks to the orifices 64 provided, an intermixing of the filling portion. A check valve 66 prevents, during the pendulating mixing motion of the mixing piston 56, a rising of the filling into the mixing piston rod 58. Above the mixing and metering cylinder 54, a drive cylinder 68 is provided for the proportioning piston 60. At the bottom, the drive cylinder 68 is delimited by the upper cylinder wall $54_o$ of the cylinder 54, at the top by a cylinder wall 70. Within the drive cylinder 68, a drive piston 72 is provided which is fixedly arranged on the piston rod 62 and slides sealingly along the wall of the drive cylinder 68. A pneumatic or hydraulic power system with feed and, respectively, discharge lines 74 for a drive pressure medium terminates directly in the zone of the cylinder-defining walls 70 and $54_o$, respectively, into the cylinder pressure chambers defined by the piston 72. Above the drive cylinder 68, a drive cylinder 76 is arranged for the mixing piston 56. This drive cylinder 76 is defined at the bottom by the cylinder wall 70, at the top by a wall 78. A drive piston 80 for the mixing piston 56 slides sealingly along the cylinder wall of the drive cylinder 76 and, for this purpose, is fixedly connected in its center to the mixing piston rod 58. At the upper end, the piston rod 62 slides sealingly along the piston rod 58. The stroke of the drive piston 80 is such that when the proportioning piston 60, in correspondence with its maximum portion, is in its uppermost stop position the mixing piston can execute the maximum stroke corresponding to the full height of the mixing and metering cylinder 54. Consequently, the height of the drive cylinder 76 is at least twice as high as the height of the mixing and proportioning cylinder 54. The mixing piston rod 58 which, as mentioned above, is of tubular shape, projects with a section absorbing the full stroke of the working piston 80 through a sealing aperture out of the terminal wall 78 of the arrangement. At that location, the tubular piston rod 58 is connected with a flexible line to a pressure supply 82 for the foam gas. Feed and, respectively, discharge conduits, acting in dependence on the stroke direction of the piston 80, terminate in the zone of the end wall 78 and, respectively, cylinder wall 70 into the corresponding cylinder working chambers determined by the drive piston 80. The lower cylinder wall $54_u$ terminates into an outlet conduit 86 with a block valve 88 that is preferably operable electrically; from conduit 86, upon opening of the block valve 88, a container such as described in connection with FIG. 6 can be filled, preferably through its outlet valve.

Furthermore, a feed conduit 90 for filling material terminates via a check valve 92 likewise into the chamber determining the metering volume below the proportioning piston 60. The aforedescribed arrangement operates as follows:

Starting with a position wherein the metering volume underneath the proportioning piston 60 has been squeezed out, the metering piston 60 is lifted with the block valve 88 being closed, by placing the cylinder working chamber of the drive cylinder 68 under pressure below the drive piston 72 by the lower one of conduits 74. The check valve 92 is opened against the bias of its valve spring by the suction effect of the metering piston 60, assisted, if need be, by charging the conduit 90 with liquid pressurized filling material, and the liquid filling material is taken into the mixing and proportioning cylinder 54 in the direction indicated by arrow a. Thereafter, by charging the lower working chamber of the drive cylinder 76 through the lower one of conduits 84, the mixing piston 56 is lifted and foam gas is forced under pressure through the mixing piston rod 58 into the previously sucked-in portion of filling material, the check valve 66 assuming the open position. Subsequently or simultaneously, the required pressure is set in the mixing material by exposing the upper working chamber of the cylinder 68 to pressure, and the mixing piston 56, as indicated by arrow b, is reciprocated in the filling material portion with the foam gas by applying pressure alternatingly, or, respectively, opening of the conduits 84. Once this mixing step is ended, the filling, mixed with the foam gas, is forced out by opening the block valve 88 with further pressurization of the working chamber above the drive piston 72 for the pressure and metering piston 60 and, according to FIG. 6, forced, with opening of the container check or block valve 15, into the filling chamber 4 opening up under the pressure of the filling against the propellant gas pressure in the propellant gas chamber 6. It is self-evident that the drive cylinders for mixing piston and metering piston can also be arranged in a different way. Thus, for example, a drive cylinder for the mixing piston can ride on the proportioning piston rod 62, or drive cylinder for mixing piston and drive cylinder for metering piston can be located with respect to the mixing and metering cylinder 54 on opposite sides; correspondingly, the conduits 86 and 90, respectively, are in such a case extended laterally out of the cylinder 54.

As mentioned in the foregoing, the mixing step involving the liquid filling and the foam gas can be substantially accelerated by the following preferred method. The mixing and proportioning cylinder 54 is not completely filled with filling material during the upward movement of the proportioning piston 60—taking in filling material by suction. For this purpose, for example, in a first phase during which the metering piston 60 travels from its lowermost position upwards, the block valve 88 is maintained in the open position during a predetermined time span so that the metering cylinder 54 first fills partially with air. After closing the block valve 88, the proportioning piston 60 takes in filling material in the manner set forth above. It is understood readily that the only partial filling of the proportioning cylinder 54 can also be performed with the aid of a separate filling material metering cylinder provided especially for this purpose, introducing the volume into the proportioning cylinder 54 which is desirable without entirely filling the latter.

While the mixing piston 56 is reciprocated in the way described above, foam gas is introduced in the way set forth in the foregoing. The residual volume in the proportioning cylinder 54 not occupied by the filling permits ready frothing of the filling whereby the filling surface area available for absorbing the subsequently fed foam gas is greatly enlarged, substantially accelerating absorption of the foam gas.

As a result, a system is obtained combining the ready frothing of the filling by way of the corresponding enlargement of the surface area actually with the foam gas absorption. Once the intended amount of filling and foam gas has been mixed, the filling-foam gas mixture is discharged under pressure by opening the block valve 88, as described above. By the discharge pressurization by metering piston 60, the foaming in the metering cylinder 54, previously utilized for increasing the mixing speed, is reversed, and the foam gas-filling mixture is dispensed.

I claim:

1. A process for preparing and dispensing a spontaneously foaming material for filling into a container, wherein the material filled in is pressurized, comprising the steps of filling a liquid material and foam gas into a preparation container, mixing said liquid filling material and said foam gas within said preparation container to form said spontaneously foaming material, dispensing a metered quantity of said spontaneously foaming material formed within said preparation container from said preparation container to fill said quantity into said container, and controlling pressure within said preparation container at least during said mixing and controlling pressure of said metered quantity of said spontaneously foaming material dispensed.

2. The process of claim 1, said controlling of said pressure within said preparation container during said mixing being performed so as to allow frothing of liquid material mixed with foaming gas during said mixing in order to accelerate said mixing by an enlargement of surface area resulting from said frothing.

3. A device for preparing and dispensing a spontaneously foaming filling material for filling into a container wherein filled-in material is pressurized, comprising a pressure container with inlets for a liquid filling material and a foam gas, mixer means within said pressure container for mixing liquid filling material and foam gas to form said spontaneously foaming filling material therein, metering means for dispensing a metered quantity of said spontaneously foaming material from said pressure container towards said container to be filled, and means for controllably pressurizing said pressure container at least during mixing and for controllably pressurizing said quantity during dispensing.

4. The device according to claim 3, said means for controllably pressurizing said pressure container and said quantity being formed by at least one pressurizing piston, said pressure container forming a cylinder for said at least one pressurizing piston.

5. The device of claim 3, said metering means being formed by a metering piston, said pressure container forming a cylinder for said metering piston.

6. The device of claim 5, said metering piston defining said means for controllably pressurizing said pressure container and said quantity during dispensing by said metering means.

7. The device according to claim 3, said mixer means being formed by at least one mixing piston, said pressure container forming a cylinder for said at least one mixing piston.

8. The device according to claim 3, said mixer means comprising a mixing piston, said metering means and said means for controllably pressurizing being formed by a pressurizing and metering piston, said pressure container forming a cylinder for said mixing and said pressurizing and metering piston.

9. The device according to claim 8, where said mixer means further comprises a piston road connected to said mixing piston and said means for controllably pressurizing further comprises a piston rod connected to said pressurizing and metering piston, the piston rod of said mixer means extending coaxially through the piston road of said means for controllably pressurizing.

10. The device according to claim 8, further comprising a drive arrangement for driving said mixing piston and said pressurizing and metering piston within said cylinder.

11. The device according to claim 10, said drive arrangement being formed by a drive cylinder arrangement with dual pistons, a cylinder for said drive pistons being formed by the cylinder also said pressure container.

12. The device according to claim 8, said mixing piston comprising a piston rod, one of said inlets being coaxially led through said piston rod of said mixing piston.

13. The device according to claim 12, said one inlet comprising a check valve to prevent material filled into said cylinder to be pressed downstream said inlet during a mixing operation by said mixing piston.

* * * * *